United States Patent [19]

Hwang et al.

[11] 4,355,316

[45] Oct. 19, 1982

[54] OFFSET J-HOOK REFLECTOR ANTENNA

[75] Inventors: Yeongming Hwang; Ching C. Han, both of Los Altos; David F. Ford, San Jose, all of Calif.

[73] Assignee: Ford Aerospace & Communications Corp., Dearborn, Mich.

[21] Appl. No.: 189,437

[22] Filed: Sep. 22, 1980

[51] Int. Cl.[3] ..... H01Q 1/02

[52] U.S. Cl. ..... 343/840; 343/912

[58] Field of Search ..... 343/840, 915, 902, 912

[56] References Cited

U.S. PATENT DOCUMENTS

| | | | |
|---|---|---|---|
| 2,534,271 | 12/1950 | Kienow | 250/33.65 |
| 2,786,998 | 3/1957 | Davis | 343/915 |
| 3,045,239 | 7/1962 | McClellan et al. | 343/776 |
| 3,230,537 | 1/1966 | Bartholoma | 343/756 |
| 3,530,476 | 9/1970 | Ravenscroft | 343/761 |
| 3,599,219 | 8/1971 | Holtum et al. | 343/840 |
| 3,696,435 | 10/1972 | Zucker | 343/779 |
| 3,740,755 | 6/1973 | Grenzback | 343/840 |
| 3,864,688 | 2/1975 | Hansen et al. | 343/756 |
| 3,936,837 | 2/1976 | Coleman et al. | 343/781 |
| 4,012,743 | 3/1977 | Maciejewski | 343/781 |
| 4,021,816 | 5/1977 | Peck | 343/840 |
| 4,047,180 | 9/1977 | Kuo et al. | 343/784 |

FOREIGN PATENT DOCUMENTS

| | | | |
|---|---|---|---|
| 1064124 | 8/1959 | Fed. Rep. of Germany | 343/840 |
| 5487 | 11/1979 | Italy | 343/840 |

*Primary Examiner*—David K. Moore

*Attorney, Agent, or Firm*—Peter Abolins; Clifford L. Sadler

[57] ABSTRACT

This specification discloses a microwave antenna system using an offset J-hook feed to achieve low sidelobe energy level over the entire radiation space from an electrical circular reflector antenna. An electromagnetic horn is positioned along the central axis of symmetry of a parabolic reflector. A waveguide feed is coupled to the horn and intersects the reflective surface at a position offset from the axis of symmetry.

4 Claims, 6 Drawing Figures

OFFSET J-HOOK REFLECTOR ANTENNA

BACKGROUND OF THE INVENTION (1) Field of the Invention

This invention relates to microwave antenna systems.

(2) Prior Art

Various types of microwave antenna systems are known. For example, a center fed J-hook support structure is known to provide a mechanically simple feed support for a reflector antenna. However, such an antenna may not have a desirably small size and low sidelobe radition pattern.

Referring to FIG. 1, there is shown a known antenna system, such as that disclosed in U.S. Pat. No. 2,534,271 for an antenna system issued Dec. 19, 1952 to Kienow. This patent teaches an antenna system wherein the J-hook feed device is attached to the edge of a portion of a parabolic reflecting surface. The reflecting surface is not centered about the axis of surface revolution (i.e., the axis of symmetry) and the feed horn does not point along the axis of surface revolution to the reflective surface. That is, the reflector used in the Kienow antenna system is an offset reflector surface which is formed by an off-center section of a paraboloid. The stated aim or object of the Kienow patent is to provide increased directional accuracy. However, the system does not provide for a desired manipulation of the sidelobes so as to produce a particular antenna radiation pattern. Typically, it is desirable to substantially reduce or eliminate the present of sidelobe. In particular, the Kienow microwave antenna system includes a circular off-center section of a paraboloid and an electromagnetic horn disposed substantially at the focal point of the paraboloid. The line corresponding to the direction of maximum response of the horn intersects the surface of the section at a point equal to eliminate the edges of the section.

The problem of reducing the sidelobe radiation pattern is better understood by an appreciation that the magnitude of sidelobe energy radiated by a reflector antenna is controlled by several different contributors. These can be divided into three major categories which depend on the source of sidelobe energy: direct feed illumination and spillover; support strut scattering; and mechanical tolerance effects. The first and third categories are present in all reflector-type antenna systems; the second, support structure scattering, is present only in symmetrical, front-fed antennas. In order to successfully describe the complete sidelobe envelope, each of these factors must be evaluated and vectorally summed to provide the total field at a given point in space.

1. APERTURE ILLUMINATION SIDELOBES

As a result of its energy distribution and size, an aperture antenna will produce a diffraction pattern which defines the main beam energy content (efficiency) and the magnitude and distribution of sidelove energy. Because the radiation intensity for normal illumination functions diminishes rapidly within 10 beam widths from axis, the aperture diffraction pattern will mainly affect sidelobes near the main beam. Consequently, the intensity of the first several sidelobes is primarily controlled by the radiation characteristics of the feed in a prime focus design.

2. REFLECTOR EDGE DIFFRACTION AND FEED SPILLOVER SIDELOBES

The feed radiation pattern also has a direct influence on the wide-angle sidelobes generated by the reflector because of scattering at the reflector edge. This effect contributes to sidelobe energy over a wide region from about 30° onward, reaching a maximum near the reflector edge angle. The effect of edge diffraction can be evaluated using the Geometric Theory of Diffraction (GTD) (Ratnasiri, Kouyoumjian & Pathak, 1970), and controlled by the choice of feed and reflector edge geometry. In the region not subtended by the reflector, the sidelobe energy is also enhanced by direct feed radiation or forward spillover. Control of this energy can be accomplished by proper feed design or by providing physical extensions to the reflector edge.

3. FEED AND SUPPORT-STRUCTURES-BLOCKAGE SIDELOBES

The feed is located in the central portion of the reflector, nearly circular, and generally several wavelengths in size. Because of its size, the energy scattered by the feed can be evaluated by assuming that the incident energy from the reflector is completely blocked by a flat plate with a cross section that corresponds to the feed. Consequently, the sidelobes produced by central blockage can be readily evaluated by considering a modified aperture distribution that consists of the illuminated aperture with a central non-illuminated region. Since this area is small compared with the total reflector area, its diffraction pattern is quite broad in angular extent. This will tend to increase the level of sidelobes located within about 20 beam widths of the main lobe. The blockage pattern is also out-of-phase with respect to the main-beam radiation; this generally causes the central blockage to increase in only the odd numbered sidelobes.

4. FEED-SUPPORT-STRUCTURE-SCATTERING SIDELOBES

In a circular antenna, the feed (or subreflector) mechanical support structure will scatter a portion of the energy radiated by the feed and reflector aperture. This scattered energy can provide major contributions to both the near main beam and wide angle sidelobe levels. Unfortunately, the problem of strut diffraction is very difficult to treat analytically and only recently have attempts been made to solve this problem. In the treatment of strut scattering, a differentiation should be made between plane wave and spherical wave scattering. Plane wave scattering refers to the diffraction of collimated energy emerging from the reflector surface. This scattering has two main components: scattered energy which does not intersect the reflector, and energy which does insersect the reflector. Analysis of these two components provides a complete scattering representation for reflector support structures which are only weakly illuminated by the feed horn, such as a bipod or tripod support attached to the reflector edge. In the second class of support structures, such as J-hook configurations, the strut is illuminated by both the feed (spherical wave) and collimated reflector energy (plane wave). To fully describe the scattering phenomenon in this type of structure, it is necessary to account for several multiple reflections. A mathematical treatment of these scattering mechanisms through application of the GTD has enabled the prediction of sidelobe levels due to support strut scattering.

5. REFLECTOR-SURFACE-ROUGHNESS SIDELOBES

The occasional surface roughness of a reflector, which occurs due to manufacturing, can degrade both the gain and sidelobe levels. These effects can be studied using Ruze's method (1966). Because this method employs statistical techniques, however, the results provide only a rough indication of the sidelobe performance of a given reflector. Only through calculations using the measured surface contour, can precise performance predictions be achieved. Nevertheless, the method does provide an indication of the maximum allowable surface roughness needed to satisfy a given sidelobe requirement. In addition, mechanical misalignments and environmental effects can degrade sidelobe performance; these effects are difficult to quantify and therefore are neglected in this study.

The total sidelobe response of a given antenna design is the vector sum of the sidelobe energy generated by the various mechanisms described above. In order to reduce the complexity of analysis, however, the radiation sphere can be divided into three spatial regions: the first few sidelobes region, the near-in sidelobe region, and the wide-angle sidelobe region. Within each region, some of the mechanisms are of much more importance than others. In the first region, the level of the first few sidelobes is controlled primarily by the reflector illumination (feed) and by the amount of blockage area due to the feed and its supporting structure. In the second region, however, sidelobe levels are predominately due to the scattering of the feed supporting structure. The radiation field intensity in the wide-angle sidelobe region is mainly controlled by the feed spillover energy and the edge diffraction. In the design of a low sidelobe reflector antenna, the effect of the dominant mechanism in each region can be considered separately. These are some of the problems this invention overcomes.

SUMMARY OF THE INVENTION

A microwave antenna system includes a reflective surface formed as the center section of a paraboloidal reflector having a concave surface which is a paraboloid of revolution, i.e., the surface obtained by spinning a parabola about is axis. An electromagnetic feed horn is positioned along the axis of symmetry of the surface of the paraboloid of revolution. A waveguide feed coupled to the horn intersects the reflective surface at a position offset from the axis of symmetry between the axis and the edge of the reflector. The particular offset and the particular shape of the waveguide from the reflective surface to the electromagnetic feed horn affects the antenna radiation pattern and is advantageously chosen to minimize the sidelobes. As a result, there is achieved low sidelobe energy level over the entire radiation space from an electrically small circular reflector antenna. Antennas in accordance with an embodiment of this invention can be used in a low cost ground antenna station to satisfy FCC or CCIR's sidelobe profile requirement. A typical feed uses a wide flare corrugated horn.

The advantages of an antenna in accordance with an embodiment of this invention is particularly well suited as a low sidelobe, relatively small earth terminal antenna. The antenna is easily transportable because it can be broken down into easily transportable symmetric sections. Such a configuration also reduces fabrication cost.

DETAILED DESCRIPTION OF THE INVENTION

Figure 1:
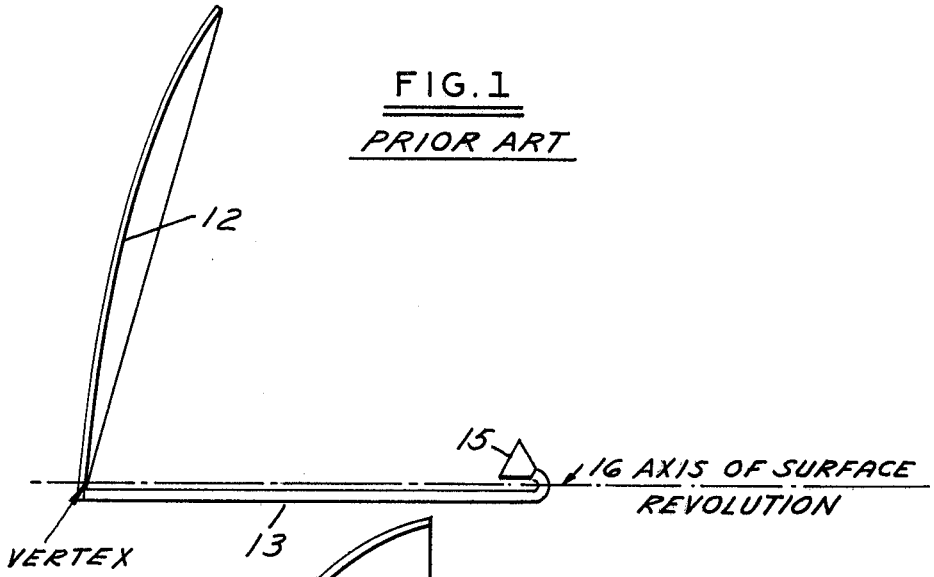
FIG. 1 PRIOR ART
FIG. 1 is a central section view of a reflective surface and feed horn in accordance with the prior art.
Figure 2:
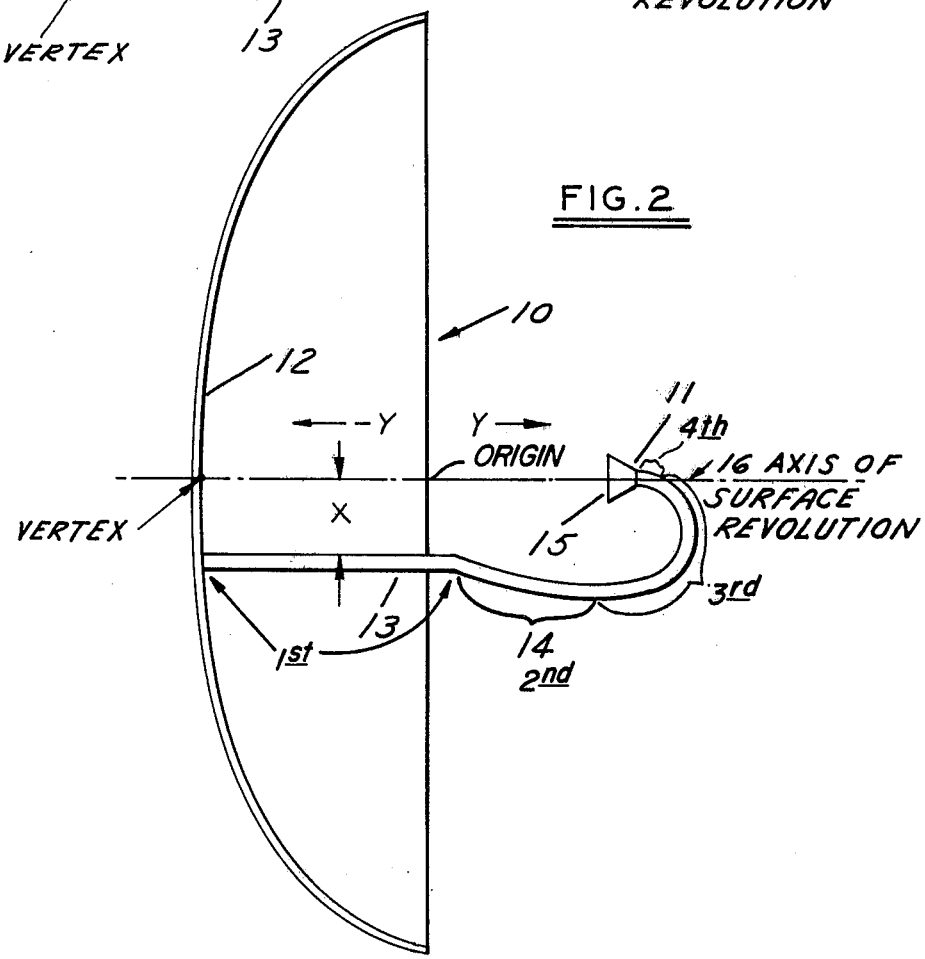
FIG. 2 is a central section view of a reflective surface and a feed horn in accordance with an embodiment of this invention.
Figure 3:
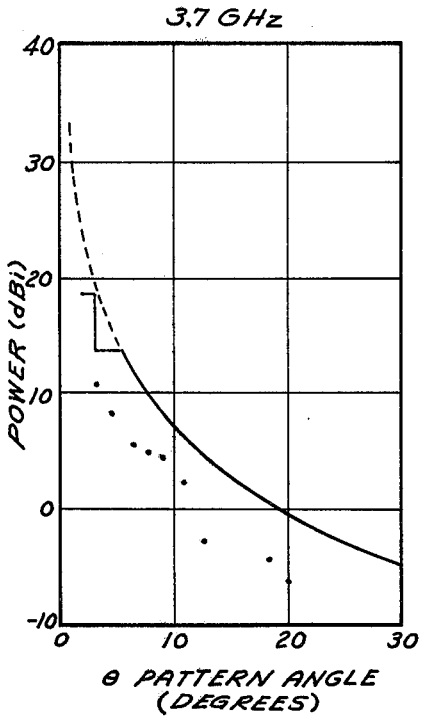
FIGS. 3, 4, 5 and 6 are graphical representations of the power verses the pattern angle of an antenna in accordance with an embodiment of this invention for increasing frequency of 3.7 4.2, 5.9 to 5 and 6.4 to 5 GHz, respectively.
Figure 4:
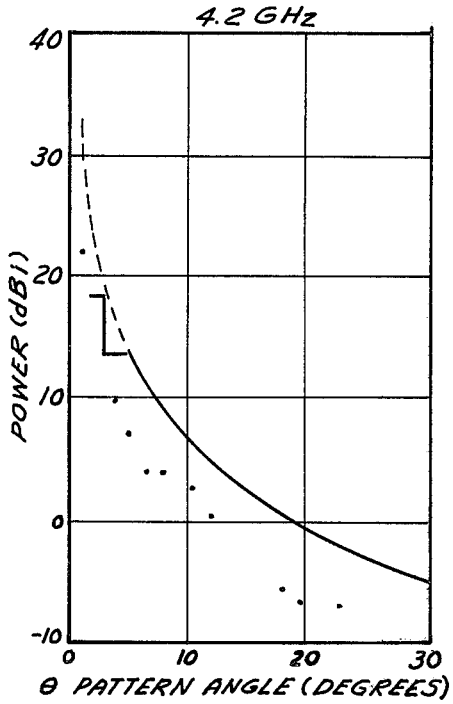
Figure 5:
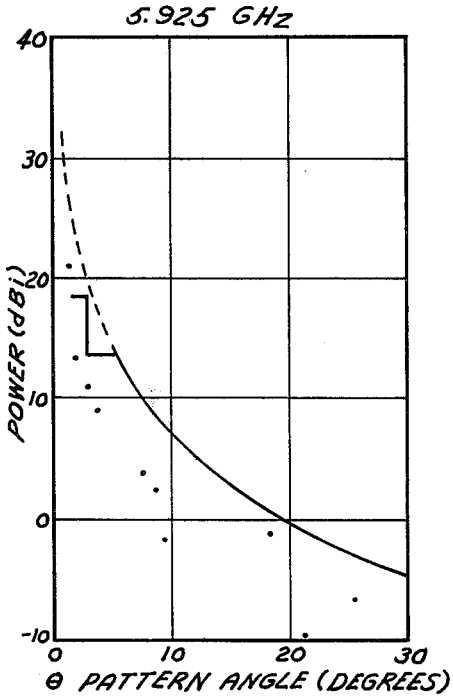
Figure 6:
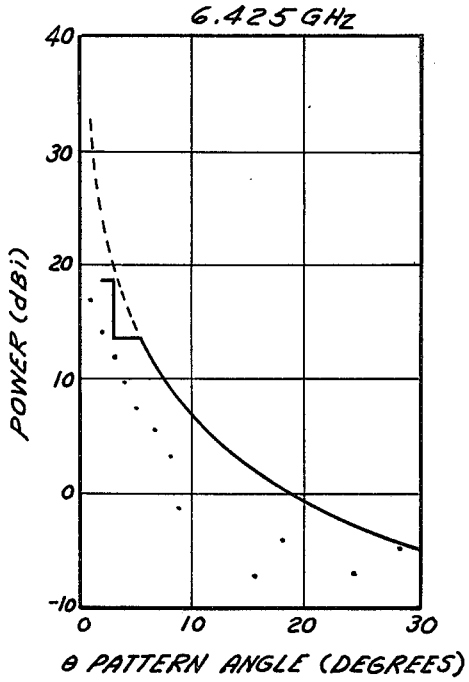

Referring to FIG. 2, a J-hook reflector antenna system 10 includes a paraboloidal reflecting element 12 formed as a surface of revolution about an axis of revolution 16, and a radiating element 11. For example, the radiating element 11 can be a feed horn. A waveguide 13 connects radiating element 11 to a position on reflecting element 12 which is offset from axis of revolution 16. Waveguide 13 includes an intermediate section 14 between feed horn 15 and reflecting element 12. The particular configuration of waveguide 13 and the amount of offset from surface revolution 16 is chosen so as to produce the desired antenna pattern.

The offset of J-hook reflector antenna system 10 causes the radiating element 11 to illuminate the lower part of waveguide 13 adjacent reflecting element 12. The energy is then scattered and reflected by reflector element 12. In general, this "feed (11)-strut (13)-reflector (12)" is relatively strong. An optimum offset distance is determined by minimizing this "feed (1)-strut (13)-reflector (12)" scattered energy.

When the amount of offset is 16 inches, the diameter is 196.85 inches and the focal distance to diameter ratio is 0.35 the J-hook cross section is 2.3 inches in diameter then FIGS. 3, 4, 5 and 6 show the graphical relationship of the power to the pattern angle for increasing frequencies of 3.7, 4.2, 5.925 and 6.425 GHz. That is, the graph shows the computer worse case sidelobe for an optimum J-hook antenna. The highest sidelobe level occurs in the 18° region. This high peak is due to the "feed (11)-strut (13" scattering in a segment 14 of waveguide 13 (see FIG. 2). The coordinates of offset J-hook reflector antenna system 10 with respect to the origin shown on FIG. 2 are given below:

| Point X (Inches) | Point Y (Inches) | |
|---|---|---|
| 0 | 45.390 | ]Fourth Portion Boundary |
| 2.000 | 60.000 | Third Portion Boundary |
| 5.000 | 63.500 | |
| 8.000 | 66.000 | |
| 11.000 | 67.500 | |
| 13.000 | 68.000 | |
| 15.000 | 67.500 | |
| 18.000 | 66.000 | |
| 21.000 | 63.500 | |
| 24.000 | 60.000 | |
| 26.000 | 57.000 | Third Portion Boundary |
| 28.000 | 49.000 | Second Portion Boundary |
| 30.000 | 38.000 | |
| 28.000 | 27.000 | |
| 26.000 | 19.000 | |
| 24.000 | 16.000 | |

-continued

| Point X (Inches) | Point Y (Inches) | |
|---|---|---|
| 20.000 | 10.000 | Second Portion Boundary |
| 16.000 | 5.000 | First Portion Boundary |
| 16.000 | −33.000 | First Portion Boundary |

More generally, an advantageous offset for a first bottom section of waveguide 13 from axis 16 is about 8% to 10% of the diameter of reflective surface 12. Further, an advantageous angle for a portion of an intermediate section 14 is about 45% with respect to the bottom section of waveguide 13. As waveguide 13 extends further from reflective surface 13 it bends back toward axis 16 and then along axis 16 in a direction toward reflective surface 12 to be coupled to radiating element 11.

It may be particularly desirable to use a corrugated feed horn design for a prime focus antenna. Such a corrugated horn offers the advantages of axial symmetry of the radiation pattern and insensitivity of beam width to frequency. The combination of axial symmetry and octave bandwidth are the result of the geometry of the corrugated horn. The corrugations force zero current along the walls, thereby equalizing the E- and H-plane beam widths. The large aperture and flare angle generate a several hundred degree quadratic phase error across the aperture; this phase error compensates the normal frequency effect on beam width. The result is a feed having 18 to 20 dB edge taper over the 3.7–6.425 GHz frequency band.

Various modifications and variations will no doubt occur to those skilled in the various arts to which this invention pertains. For example, depending upon the particular antenna pattern and design, the configuration of the waveguide and feed horn with respect to the reflective surface may be varied from that disclosed herein. These and all variations which basically rely on the teachings through which this disclosure has advanced the art are properly considered within the scope of this invention.

We claim:

1. A microwave antenna system comprising:

a reflective surface formed as a center section of a concave surface which is a paraboloid of revolution and having a central axis of symmetry;

an electromagnetic feed horn disposed along said axis of symmetry; and a waveguide feed coupled to said horn which intersects said reflective surface at a position offset from said axis of symmetry, said waveguide feed having a first portion generally extending outward from said reflective surface parallel to said axis of symmetry, a second portion bending in a first direction away from said axis of symmetry, a third portion bending toward said axis of symmetry, a fourth section extending generally toward said reflective surface and coupling to said horn so that the electromagnetic radiation in the side lobe region is reduced.

2. A microwave antenna system as recited in claim 1 wherein said offset distance is about 8% to 10% of the diameter of said reflective surface.

3. A microwave antenna system as recited in claim 2 wherein at least a section of said second portion forms about a 45° angle with respect to said first portion.

4. A microwave antenna system as recited in claim 3 wherein said offset distance is about 16 inches said reflective surface has a diameter of about 196.85 inches, the focal length to diameter ratio is about 0.35 and the waveguide feed cross section is about 2.3 inches in diameter.

* * * * *